US008995695B2

(12) United States Patent
Ohashi et al.

(10) Patent No.: US 8,995,695 B2
(45) Date of Patent: Mar. 31, 2015

(54) SPEAKER APPARATUS

(75) Inventors: Yoshio Ohashi, Kanagawa (JP); Kazuko Yamagishi, Chiba (JP); Yoshiyuki Kaku, Tokyo (JP); Yoshihiro Iwami, Saitama (JP); Shin Yamaguchi, Kanagawa (JP)

(73) Assignee: Sony Corporation (JP)

( * ) Notice: Subject to any disclaimer, the term of this patent is extended or adjusted under 35 U.S.C. 154(b) by 8 days.

(21) Appl. No.: 13/280,661

(22) Filed: Oct. 25, 2011

(65) Prior Publication Data

US 2012/0114147 A1 May 10, 2012

(30) Foreign Application Priority Data

Nov. 9, 2010 (JP) ..... P2010-251270

(51) Int. Cl.
*H04R 25/00* (2006.01)
*H04R 5/02* (2006.01)
*H04R 1/02* (2006.01)
(Continued)

(52) U.S. Cl.
CPC *H04R 1/403* (2013.01); *H04R 1/24* (2013.01); *H04R 1/26* (2013.01); *H04R 2201/028* (2013.01); *H04R 2205/022* (2013.01)
USPC ..... 381/182; 381/186; 381/334; 381/335; 381/386; 381/300; 381/301; 381/302; 381/303; 381/304; 381/305; 181/144; 181/145; 181/147; 181/199

(58) Field of Classification Search
CPC ..... H04R 1/24; H04R 1/403; H04R 1/26; H04R 9/063; H04R 7/122; H04R 5/02; H04R 2205/022; H04R 5/023; H04R 2499/13; H04S 3/00; H04S 1/002; H04S 7/301
USPC ..... 381/300–305, 334, 335, 386, 182, 186; 181/144, 145, 147, 199
See application file for complete search history.

(56) References Cited

U.S. PATENT DOCUMENTS 5,233,664 A * 8/1993 Yanagawa et al. ..... 381/89
5,430,260 A * 7/1995 Koura et al. ..... 181/144
(Continued)

FOREIGN PATENT DOCUMENTS

JP 58-182991 A 10/1983
JP 8126088 5/1996
(Continued)

OTHER PUBLICATIONS

Office Action from Japanese Application No. 2010-251270, dated Mar. 4, 2014.

*Primary Examiner* — Matthew Eason
*Assistant Examiner* — Sean H Nguyen
(74) *Attorney, Agent, or Firm* — Lerner, David, Littenberg, Krumholz & Mentlik, LLP

(57) ABSTRACT

A speaker system includes: a first speaker unit having a predetermined directivity angle in the horizontal direction; and a pair of second speaker units which are disposed opposite to each other with the first speaker unit sandwiched between them when viewed in the vertical direction and which have a directivity angle in the horizontal direction greater than the directivity angle of the first speaker unit, wherein distances from the center of the first speaker unit to the centers of the pair of second speaker units are equal to each other, and the first speaker unit and the pair of second speaker units are disposed so as to face toward the same direction.

7 Claims, 9 Drawing Sheets

(51) Int. Cl.

| | |
|---|---|
| ***H04R 9/06*** | (2006.01) |
| ***H04R 1/40*** | (2006.01) |
| *H04R 1/24* | (2006.01) |
| *H04R 1/26* | (2006.01) |

(56) References Cited

U.S. PATENT DOCUMENTS

| | | | | |
|---|---|---|---|---|
| 6,002,780 | A * | 12/1999 | Espiritu | 381/182 |
| 6,026,927 | A * | 2/2000 | Burdett et al. | 181/144 |
| 6,057,659 | A * | 5/2000 | Akiyama et al. | 381/98 |
| 6,643,379 | B1 * | 11/2003 | Onglao | 381/351 |
| 7,516,932 | B2 * | 4/2009 | Engebretson et al. | 248/317 |
| 7,936,891 | B2 | 5/2011 | Henricksen et al. | |
| 2004/0156518 | A1 * | 8/2004 | Nakamura | 381/335 |
| 2005/0063555 | A1 * | 3/2005 | Berardi et al. | 381/104 |
| 2005/0169493 | A1 * | 8/2005 | Horbach | 381/335 |
| 2006/0126878 | A1 | 6/2006 | Takumai et al. | |
| 2006/0151237 | A1 * | 7/2006 | Oxford et al. | 181/199 |
| 2006/0182298 | A1 * | 8/2006 | Stiles et al. | 381/335 |
| 2007/0110268 | A1 * | 5/2007 | Konagai et al. | 381/335 |
| 2007/0201712 | A1 * | 8/2007 | Saiki | 381/186 |
| 2008/0187155 | A1 * | 8/2008 | Hou | 381/300 |
| 2008/0192964 | A1 * | 8/2008 | Iwayama | 381/182 |
| 2008/0310661 | A1 * | 12/2008 | Kling et al. | 381/335 |
| 2009/0279721 | A1 * | 11/2009 | Tanaka | 381/303 |
| 2010/0158282 | A1 * | 6/2010 | Fujise et al. | 381/182 |
| 2010/0272271 | A1 * | 10/2010 | Hayakawa et al. | 381/59 |
| 2010/0272295 | A1 * | 10/2010 | Nakatani | 381/160 |
| 2011/0091044 | A1 * | 4/2011 | Lee et al. | 381/18 |
| 2011/0142266 | A1 * | 6/2011 | Lee et al. | 381/182 |
| 2012/0020512 | A1 * | 1/2012 | Tracy | 381/387 |
| 2012/0314888 | A1 * | 12/2012 | Tracy | 381/182 |

FOREIGN PATENT DOCUMENTS

| | | | |
|---|---|---|---|
| JP | 2004297752 | A | 10/2004 |
| JP | 4127156 | A | 5/2008 |
| JP | 2009-512275 | A | 3/2009 |
| JP | 2009147951 | A | 7/2009 |
| WO | 2009078164 | A1 | 6/2009 |

* cited by examiner

SPEAKER APPARATUS

CROSS-REFERENCE TO RELATED APPLICATION

The present application claims priority from Japanese Patent Application No. JP 2010-251270 filed in the Japanese Patent Office on Nov. 9, 2010, the entire content of which is incorporated herein by reference.

FIELD

The present disclosure relates to the field of techniques associated with speaker systems. More particularly, the present disclosure relates to the field of techniques for obtaining a large audible range in a high audio frequency band, the techniques involving the provision of a pair of second speaker units which are disposed opposite to each other so as to sandwich a first speaker unit between them when viewed in the vertical direction and which have a directivity angle greater than the directivity angle of the first speaker unit.

BACKGROUND

There are speaker systems including speaker units outputting sounds in predetermined respective sound ranges.

For example, such a speaker system includes at least one speaker unit disposed in a housing to output sounds in a predetermined sound range from the speaker unit (see Japanese Patent No. 4127156 (Patent Document 1)).

Such speaker units include woofers outputting low-pitched sounds, mid-range speakers outputting medium-pitched sounds, tweeters outputting high-pitched sounds, and full-range type speakers outputting sounds in all of the low-pitched, medium-pitched, and high-pitched ranges.

SUMMARY

A speaker unit as described above has directivity in the horizontal direction which depends on the range of sounds output by the unit. The directivity angle of the speaker unit becomes smaller the higher the sound range of the same, and the audible range becomes narrower accordingly. As a result, sounds from the speaker system, in particular, sounds in a high-pitched sound range may be difficult to listen depending on the position of the listener with respect to the speaker system in the horizontal direction.

It is therefore desirable to provide a speaker system in which the above-described problem is solved to provide a large audible range in a high audio frequency band.

An embodiment of the present disclosure is directed to a speaker system including a first speaker unit having a predetermined directivity angle in the horizontal direction and a pair of second speaker units which are disposed opposite to each other with the first speaker unit sandwiched between them when viewed in the vertical direction and which have a directivity angle in the horizontal direction greater than the directivity angle of the first speaker unit. Distances from the center of the first speaker unit to the centers of the pair of second speaker units are equal to each other, and the first speaker unit and the pair of second speaker units are disposed so as to face toward the same direction.

In the speaker system, sounds in a high audio frequency band are output from the pair of second speaker units in range of angles which is outside the directivity angle of the first speaker unit in the horizontal direction.

In the speaker system, the aperture of the pair of second speaker units is preferably smaller than the aperture of the first speaker unit.

By setting the aperture of the pair of second speaker units smaller than the aperture of the first speaker unit, it is ensured that the directivity angle of the second speaker units is greater than the directivity angle of the first speaker unit.

In the speaker system, audio signals substantially in the same frequency band are preferably input to the first speaker unit and the pair of second speaker units.

Since audio signals substantially in the same frequency band are input to the first speaker unit and the second speaker units, a falling edge of the audio signal input to the first speaker unit and a rising edge of the audio signal input to the second speaker units will not cross each other.

In the speaker system, the sum of sound pressure levels of the pair of second speaker units is preferably 50% of a sound pressure level of the first speaker unit or less when the first speaker unit and the pair of second speaker units face a frontward direction of the system that is at an angle of 0°.

When the sum of sound pressure levels of the pair of second speaker units is 50% of the sound pressure level of the first speaker unit or less at the angle of 0°, sounds output from the second speaker units are unlikely to affect sounds output from the first speaker unit.

In the speaker system, the distance from the center of the first speaker unit to the centers of the second speaker units is preferably 100 mm or less.

When the distance from the center of the first speaker unit to the centers of the second speaker units is preferably 100 mm or less, interference is unlikely to occur between sounds output from the first speaker unit and sounds output from the second speaker units in the audio reproduction band of the system.

The speaker system according to the present disclosure includes the first speaker unit having a predetermined directivity angle in the horizontal direction and the pair of second speaker units which are disposed opposite to each other with the first speaker unit sandwiched between them when viewed in the vertical direction and which have a directivity angle in the horizontal direction greater than the directivity angle of the first speaker unit. Distances from the center of the first speaker unit to the centers of the pair of second speaker units are equal to each other, and the first speaker unit and the pair of second speaker units are disposed so as to face toward the same direction.

Thus, the system can be provided with high directivity, and a large audible range can be obtained in a high audio frequency band.

As described above, the aperture of the pair of second speaker units may be set smaller than the aperture of the first speaker unit.

It is therefore ensured that the directivity angle of the second speaker units is greater than the directivity angle of the first speaker unit, and a large audible range can be obtained in a high audio frequency band using a simple configuration.

As described above, audio signals substantially in the same frequency band may be input to the first speaker unit and the pair of second speaker units.

It is therefore possible to prevent a reduction in a sound pressure level in a certain frequency band, and high sound quality can be achieved throughout the audio output band of the system.

As described above, the sum of sound pressure levels of the pair of second speaker units may be set at 50% of a sound pressure level of the first speaker unit or less when the first speaker unit and the pair of second speaker units face a frontward direction of the system that is at an angle of 0°.

Thus, the quality of sounds output from the first speaker unit at the angle of 0° will not be degraded, and composite sounds can be produced by the two types of speakers with high directivity.

As described above, the distance from the center of the first speaker unit to the centers of the second speaker units may be set at 100 mm or less.

It is possible to prevent any reduction ion a sound pressure attributable to interference between sounds output from the first speaker unit and sounds output from the second speaker units.

DETAILED DESCRIPTION

An embodiment of a speaker system according to the present disclosure will now be described with reference to the accompanying drawings.

Upward and downward directions (top-bottom direction), frontward and rearward directions (front-rear direction), and leftward and rightward directions (left-right direction) which will appear in the following description are defined based on an assumption that "a frontward direction" is the direction toward which a speaker unit faces and which is at an angle of 0° in terms of the directivity angle of the unit. A directivity angle is a range of angles specific to each speaker unit over which sounds at certain sound pressure levels from the speaker unit are audible for a listener.

The front-rear direction and left-right direction which will appear in the following description are used for convenience of description only, and the disclosed technique is not limited to such directions.

[General Configuration]

Figure 1:
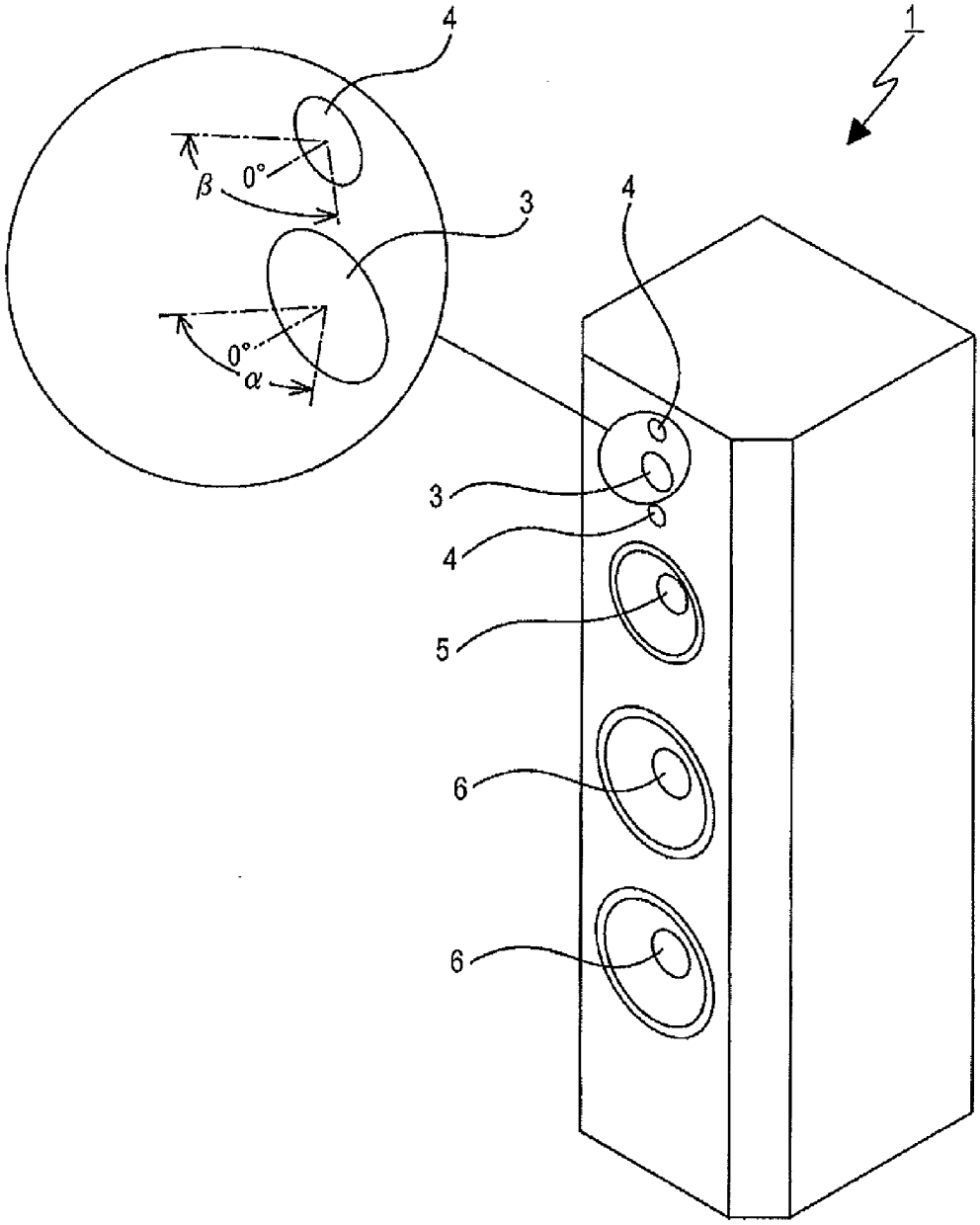
FIG. 1 is a perspective view of a speaker system according to an embodiment of the present disclosure.

A general configuration of a speaker system will now be described (see FIG. 1).

A speaker system 1 includes a first speaker unit 3 and second speaker units 4 serving as tweeters, a third speaker unit 5 serving as a mid-range speaker, and fourth speaker units 6 serving as woofers, provided in a housing 2.

All of the first speaker unit 3, the second speaker units 4, the third speaker unit 5, and the fourth speaker units 6 face toward the front side of the system (at an angle of 0°), and each unit has a predetermined directivity angle defined in the horizontal direction.

The second speaker units 4 are disposed above and below the first speaker unit 3 when viewed in the top-bottom direction of the system, and the second speaker units 4 have a directivity angle $\beta$ in the horizontal direction which is greater than a directivity angle $\alpha$ of the first speaker unit 3 in the horizontal direction.

For example, the first speaker unit 3 and the second speaker units 4 are disposed above the third speaker unit 5 provided as a mid-range speaker, and the fourth speaker units provided as woofers are disposed below the third speaker unit.

The aperture of the second speaker units 4 is smaller than the aperture of the first speaker unit 3. For example, the diaphragms of the second speaker units 4 have a diameter of 19 mm, and the diaphragm of the first speaker unit 3 has a diameter of 25 mm.

The second speaker units 4 are identical in terms of the characteristics of sounds output by them, and the system is configured such that audio signals in the same frequency band are input to the second speaker units 4.

For example, the speaker system 1 has an audio reproduction band ranging up to 20 KHz.

[Directivity of First and Second Speaker Units]

The directivity of the first speaker unit 3 and the second speaker units 4 will now be described (see FIGS. 2 to 5).

Figure 2:
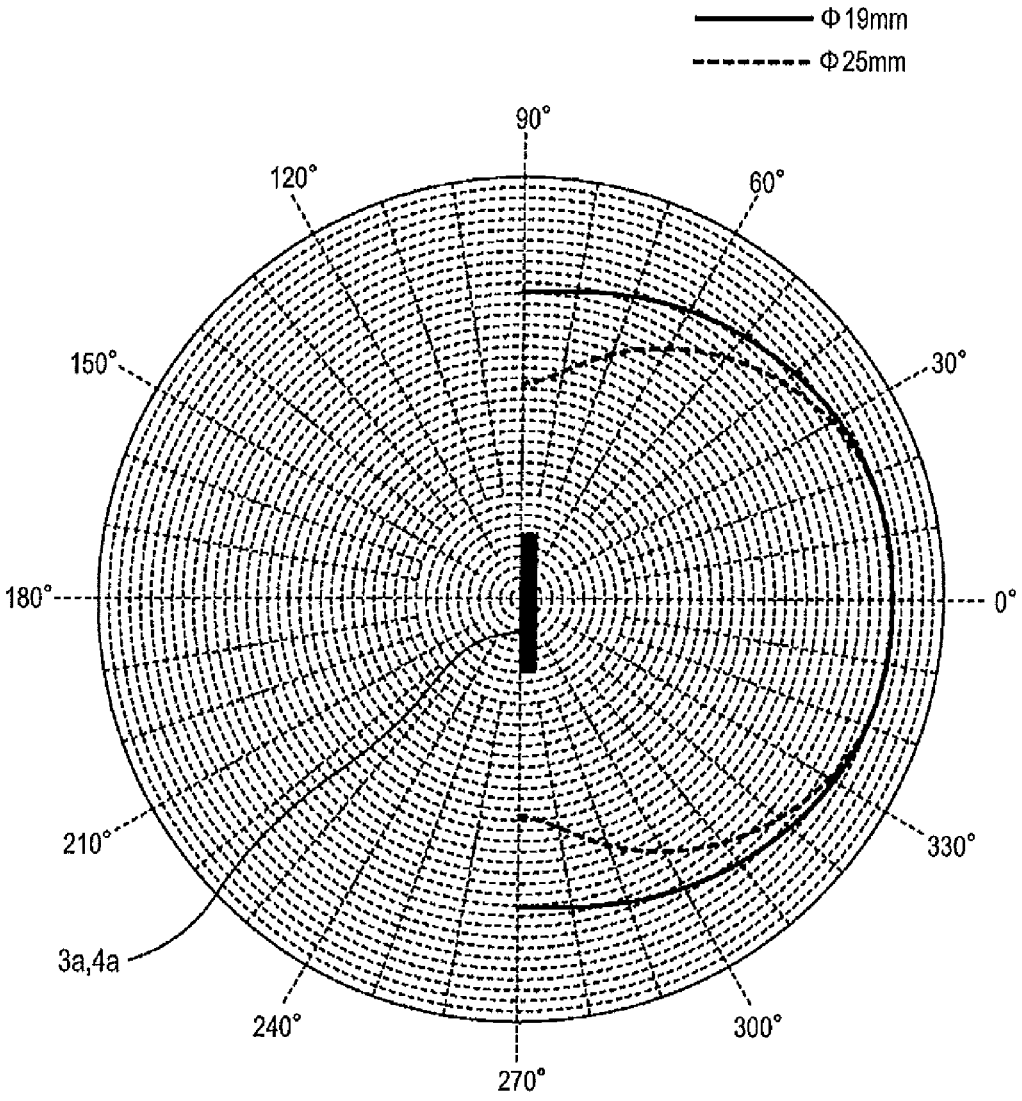
FIG. 2 is a graph showing directivity of a first speaker unit and second speaker units.

FIG. 2 is a graph showing the directivity of the first speaker unit 3 and the second speaker units 4 on an assumption that a diaphragm 3*a* of the first speaker unit 3 and diaphragms 4*a* of the second speaker units 4 are mounted on an infinite buffle. Horizontal angles (directivity angles) are plotted in the circumferential direction of the graph, and the frontward direction of the units is at an angle of 0°. The angles of 30° and 330° represent directions which are at leftward and rightward angles of 30° to the frontward direction, respectively. Sound pressure levels are plotted in the radial direction of the graph. FIG. 2 shows sound pressure levels plotted in association with the directivity angles of the first speaker unit 3 and the second speaker units 4 based on an assumption that sounds at the same sound pressure level are output from the first speaker unit 3 and the second speaker units 4 at the angle of 0°.

As will be apparent from FIG. 2, the second speaker units 4 have a directivity angle greater than that of the first speaker unit 3. The first speaker unit 3 undergoes a more significant reduction in the sound pressure level of sounds generated thereby compared to the second speaker units 4, the greater the horizontal angle defined between the direction of measurement and the frontward direction (at 0°).

Figure 3:
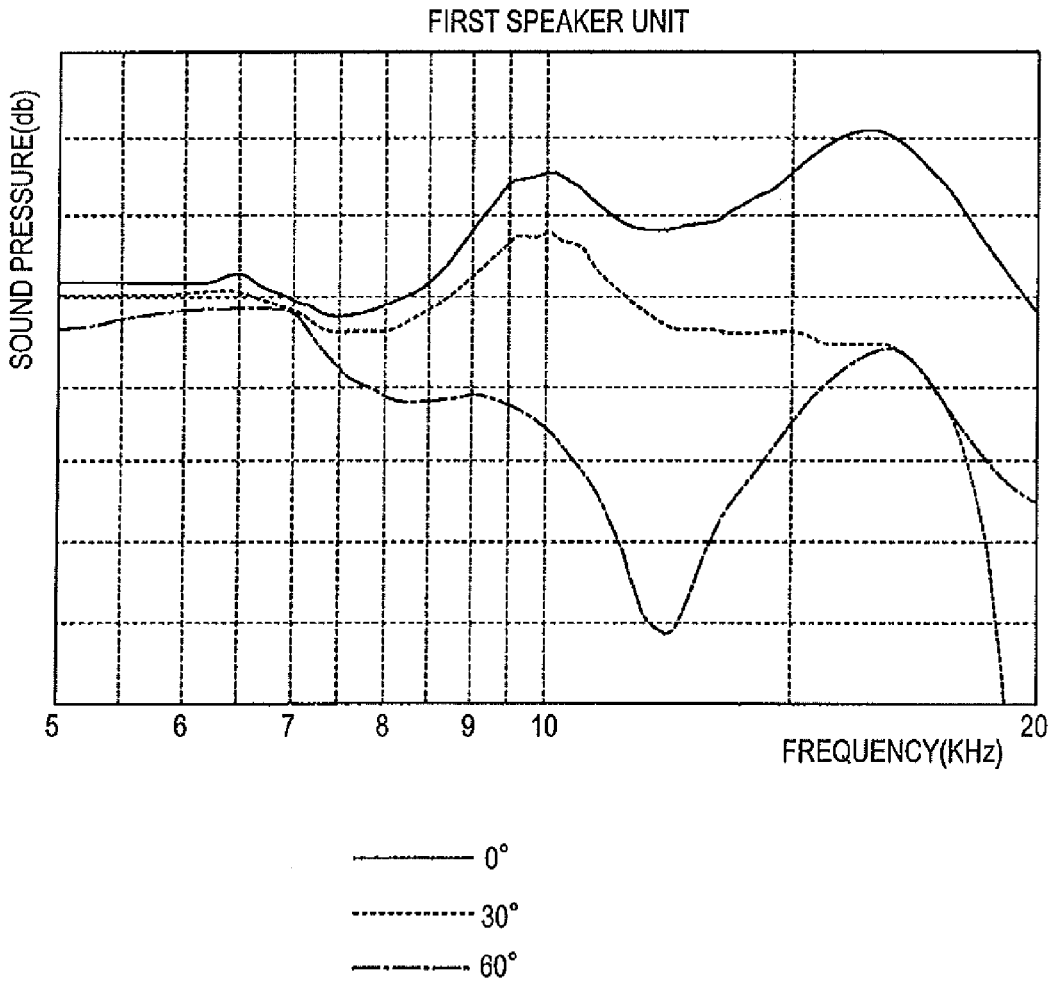
FIG. 3 shows sound pressure levels of sounds output from the first speaker unit versus frequencies.
Figure 4:
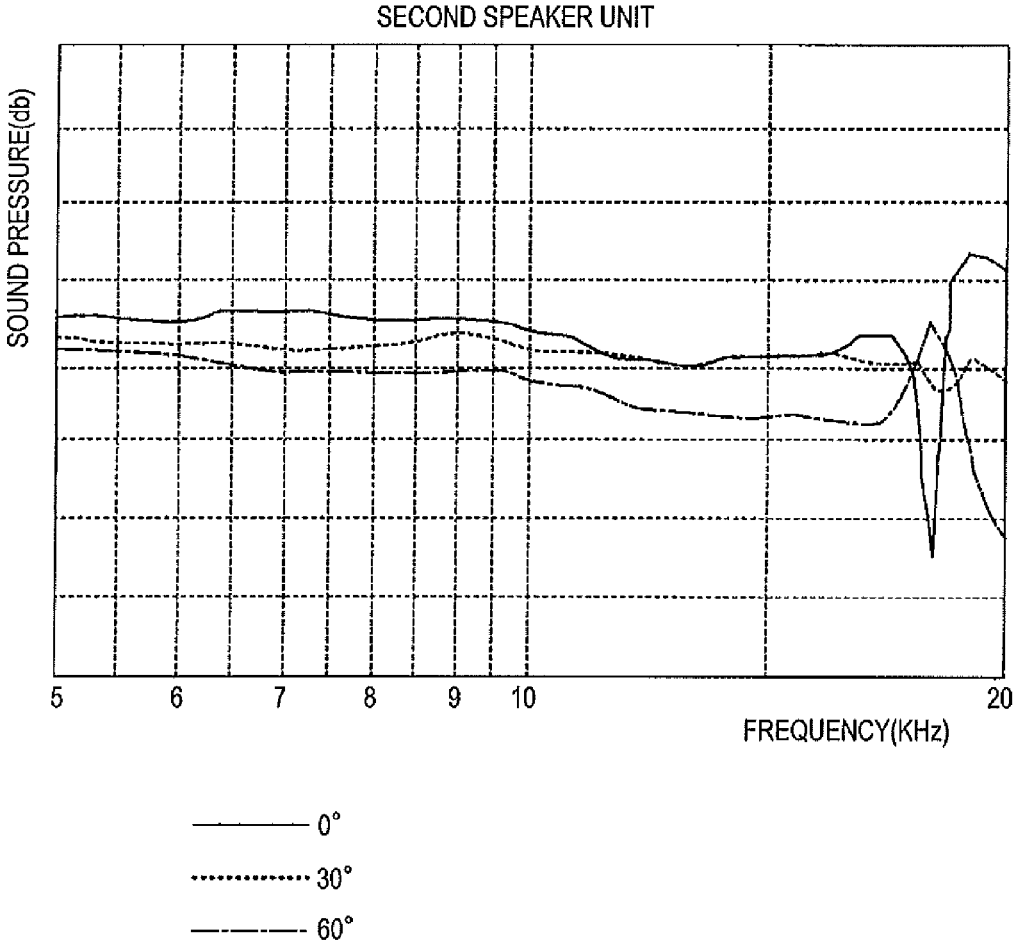
FIG. 4 shows sound pressure levels of sounds output from the second speaker units versus frequencies.
Figure 5:
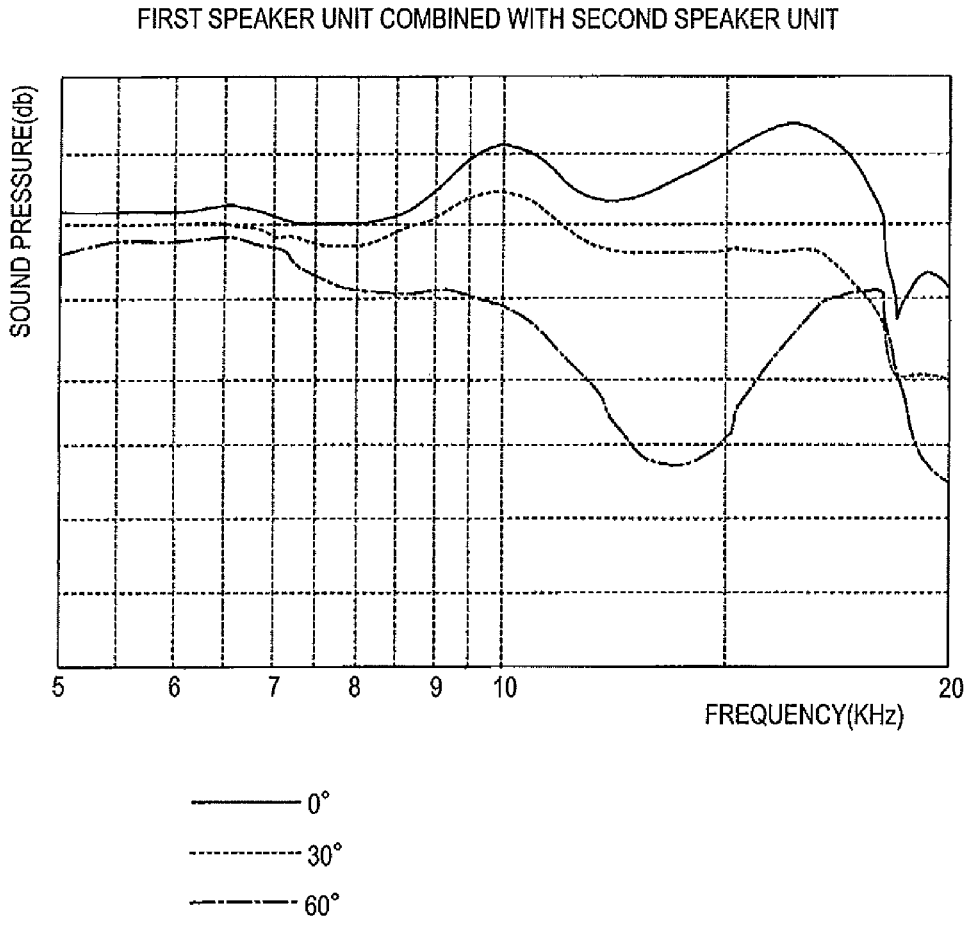
FIG. 5 shows sound pressure levels of composite sounds obtained by combining sounds output from the first speaker unit and the second speaker units.

FIGS. 3 to 5 are graphs showing sound pressure levels versus frequencies, and the graphs show sound pressure levels versus frequencies measured at angles of 0°, 30°, and 60°. FIG. 3 shows sound pressure levels of sounds output from the first speaker unit 3. FIG. 4 shows sound pressure levels of sounds output from the second speaker units 4. FIG. 5 shows sound pressure levels of composite sounds obtained by combining sounds output from the first speaker unit 3 and the second speaker units 4. Frequencies and sound pressure levels are shown along the horizontal and vertical axes of the graphs, respectively.

As shown in FIG. 3, the first speaker 3 undergoes a significant reduction in the sound pressure level near the frequency of 20 KHz at the angle of 30° and a significant reduction in the sound pressure level near the frequency of 10 and several KHz at the angle of 60°. However, it will be understood that the reduction in the sound pressure level of the first speaker unit 3 is mitigated at the angles of 30° and 60° when the first speaker unit 3 and the second speaker units are used in combination. Directivity can be improved to provide a greater audible range in a high audio frequency band by disposing the second speaker units 4 above and below the first speaker unit 3 as thus described.

In the speaker system 1, the second speaker units 4 have an aperture greater than the aperture of the first speaker unit 3.

It is therefore ensured that the directivity angle of the second speaker units 4 is greater than the directivity angle of the first speaker unit 3, and a large audible range in a high audio frequency band can be provided using a simple configuration.

In order to obtain a large audible range in a high audio frequency band, the second speaker units 4 having an aperture greater than that of the first speaker unit 3 is disposed above and below the first speaker unit 3. Thus, it is not necessary to provide the speaker system 1 in a large size in order to obtain a large audible range in a high audio frequency band.

[Audio Signals Input to First and Second Speaker Units]

Figure 6:
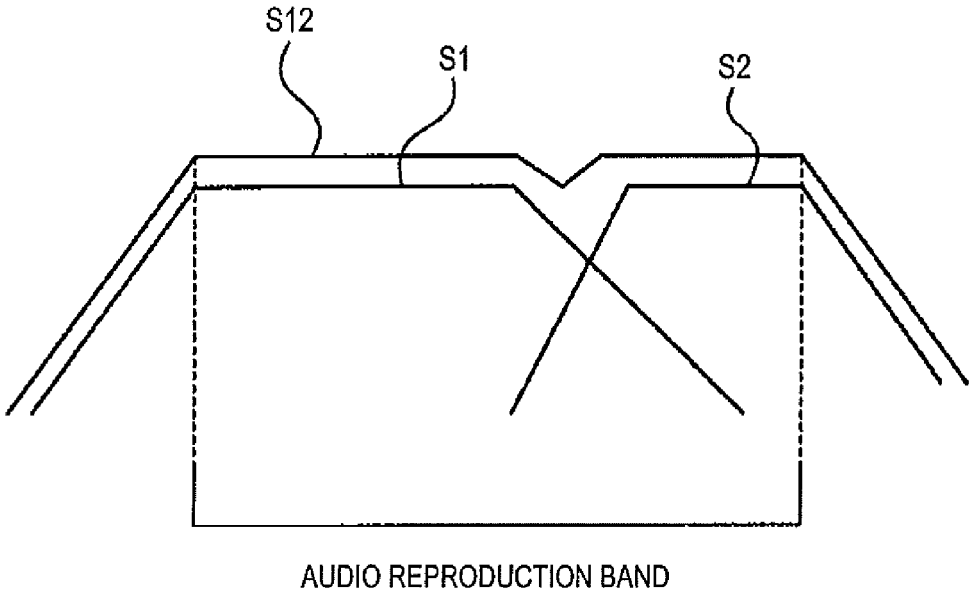
FIG. 6 is a schematic illustration of an example in which sound pressure levels of sounds output from the two types of speaker units are discontinuous.

Audio signals input to the first speaker unit 3 and the second speaker units 4 will now be described (see FIGS. 6 and 7).

As described above, the speaker system 1 is provided with the first speaker unit 3 and the second speaker units 4 which have different directivity angles. That is, the speaker system is provided with two types of speaker units. In a speaker system including two types of speaker units as thus described, audio signals S1 and S2 in predetermined frequency bands are input to the two types of speaker units, respectively, and the audio signals S1 and S2 are connected to the system through a network. When the sound pressure levels of sounds output by the two types of speaker units are discontinuous, a sound pressure level obtained by a composite audio signal S12, i.e., a combination of the audio signals, drops (dips) in a certain frequency band. Such a drop of the sound pressure level occurs when a falling edge of the audio signal S1 and a rising edge of the audio signal S2 cross each other.

Figure 7:
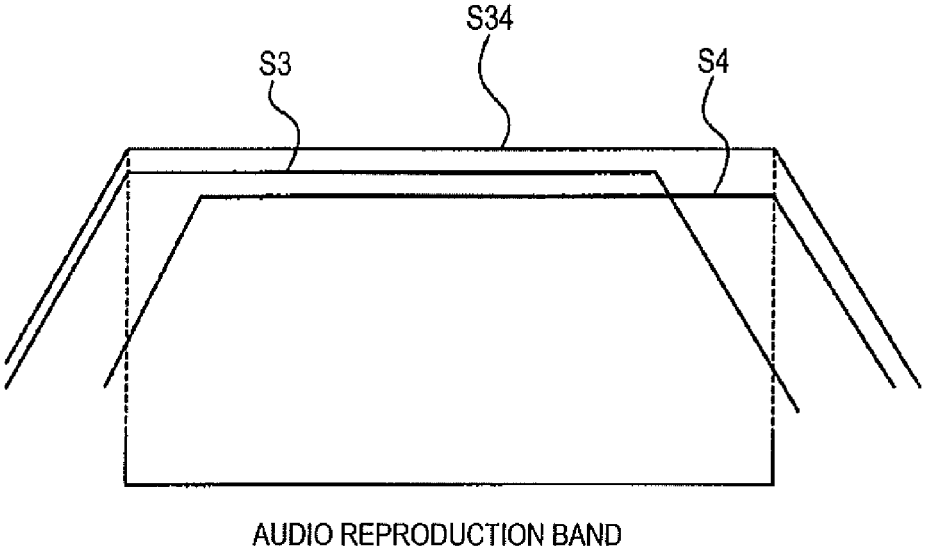
FIG. 7 is a schematic illustration of an example in which sound pressure levels of sounds output from the two types of speaker units are continuous.

In order to prevent a drop of the sound pressure level in a certain frequency band in the speaker system 1 as thus described, audio signals S3 and S4 in substantially the same frequency band are input to the first speaker unit 3 and the second speaker units 4, respectively (see FIG. 7). At this time, it is desirable that the frequency band of the audio signal S4 input to the second speaker units 4 is slightly shifted from the frequency band of the audio signal S3 input to the first speaker unit 3 toward the high frequency side. Such a slight shift of the frequency band toward the high frequency side prevents sounds output from the second speaker units 4 from becoming noise on sounds output from the first speaker unit 3 near the direction at the angle of 0°. Further, such a shift allows a sound pressure level obtained from a resultant composite audio signal S34 to be prevented from dropping in a high audio frequency band.

When the audio signals S3 and S4 in substantially the same frequency band are input to the first speaker unit 3 and the second speaker units 4, respectively, as thus described, the signals are connected through a network such that the sound pressure levels of sounds output from the first speaker unit 3 and the second speaker units 4 are continuous with each other as shown in FIG. 7.

Therefore, there will be no crossing between a falling edge of the audio signal S3 and a rising edge of the audio signal S4. Thus, a resultant sound pressure level is prevented from dropping in a certain frequency band, and high sound quality can therefore be achieved throughout the frequency band of output sounds.

[Relationship Between Sound Pressure Levels of First and Second Speaker Units]

A relationship between the sound pressure levels of the first speaker unit 3 and the second speaker units 4 will now be described (see FIGS. 8 and 9).

In the speaker system 1, the sum of the sound pressure levels of the second speaker units 4 is kept 50% of the sound pressure level of the first speaker unit 3 or less at the angle of 0°.

Therefore, when the sound pressure level of sounds output from the first speaker unit 3 is, for example, 90 db at the angle of 0°, the sum of the sound pressure levels of sounds output from the second speaker units 4 is kept at, for example, 84 db or less.

Figure 8:
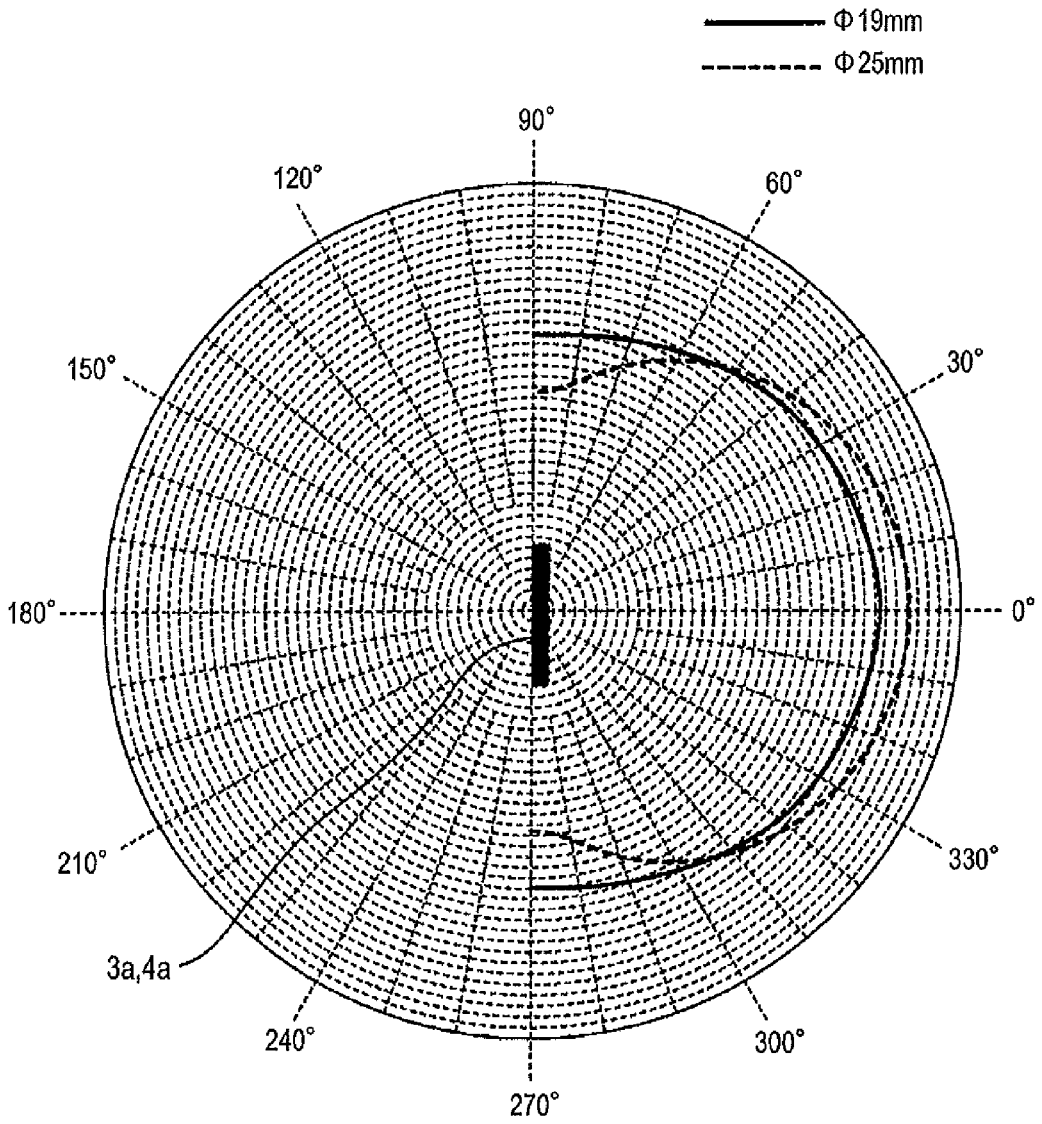
FIG. 8 is a graph showing directivity of the first speaker unit and the second speaker units observed when the sum of the sound pressure levels of the second speaker units is set at 50% of the sound pressure level of the first speaker unit or less at an angle of 0°.

FIG. 8 is a graph showing the directivity of the first speaker unit 3 and the second speaker units 4 on an assumption that a diaphragm 3*a* of the first speaker unit 3 and diaphragms 4*a* of the second speaker units 4 are mounted on an infinite baffle. Horizontal angles (directivity angles) are plotted in the circumferential direction of the graph, and the frontward direction of the units is at an angle of 0°. Sound pressure levels are plotted in the radial direction of the graph.

Figure 9:
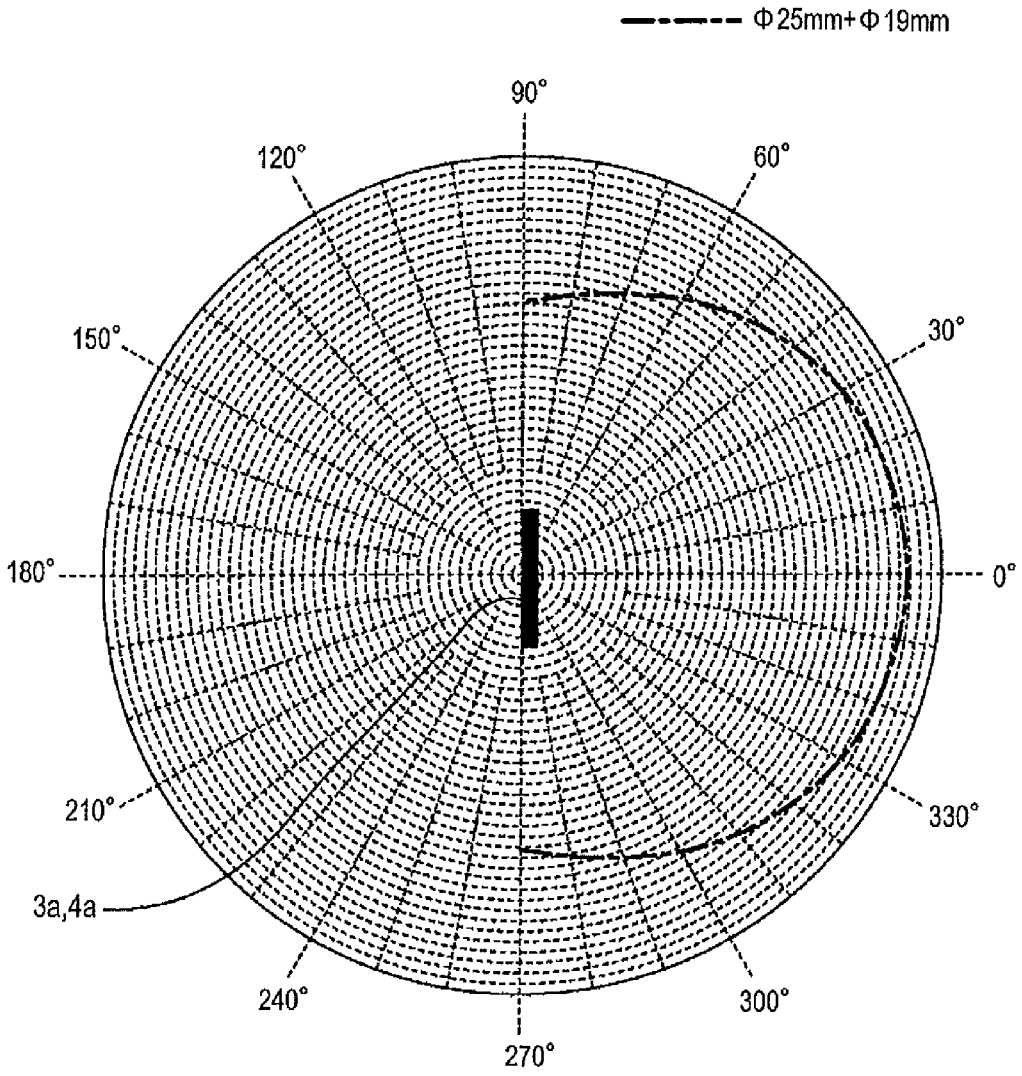
FIG. 9 is a graph showing directivity of composite sounds output from the first speaker unit and the second speaker units.

FIG. 9 is a graph showing directivity of composite sounds output from the first speaker unit 3 and the second speaker units 4, and the figure indicates that the composite sounds are kept at a high sound pressure even at angles which are far from the angle of 0° in the horizontal direction.

When the sum of the sound pressure levels of the second speaker units 4 is kept 50% of the sound pressure level of the first speaker unit 3 or less at the angle of 0° as thus described, sounds output from the second speaker units 4 are unlikely to affect sounds output by the first speaker unit 3. Therefore, the quality of sounds output from the first speaker unit 3 at the angle of 0° will not be degraded, and composite sounds can be produced by the two types of speakers with high directivity.

[Distance Between First and Second Speaker Units]

Figure 10:
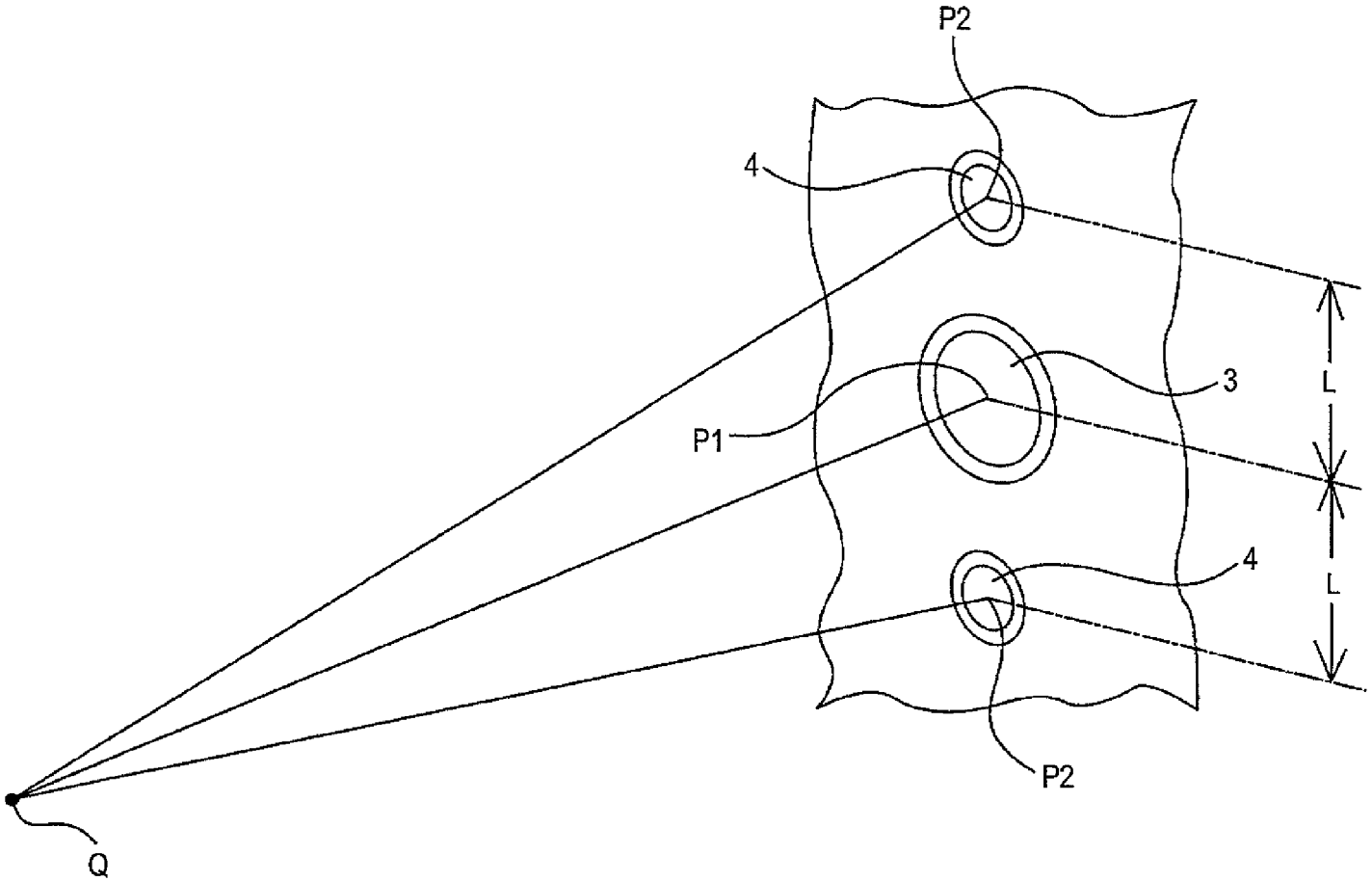
FIG. 10 is an illustration for explaining a relationship between distances between the first speaker unit and the second speaker units.

The distance between the first speaker unit 3 and the second speaker units 4 will now be described (see FIG. 10).

In the speaker system 1, distances L from a center P1 of the first speaker unit 3 to centers P2 of the second speaker units 4 are set equal, e.g., at 100 mm or less. The distances L are preferably 50 mm or less.

In general, a listener listens to sounds output from the speaker system 1 at a listening point which is 1 m or more apart from the system.

For example, let us assume that a listening point Q is 1 m apart from the center P1 of the first speaker unit 3 where the distances L are 50 mm. Then, the distances from the listening point Q to the centers P2 of the second speaker units 4 are 1.00125 m. At this time, the difference between the distance from the listening point Q to the center P1 and the distance from the listening point Q to the centers P2 is as small as 1.25 mm. A reduction in a sound pressure level attributable to interference between sounds output from the first speaker unit 3 and sounds output from the second speaker units 4 is unlikely to occur in the frequency range up to 20 KHz that is the audio reproduction band of the speaker system 1. For example, when the distances L are 100 mm, the distance from the listening point Q 1 m apart from the center P1 of the first speaker unit 3 to the centers of the second speaker units 4 is about 1.005 m. At this time, the difference between the distance from the listening point Q to the center P1 and the distance from the listening point Q to the centers P2 is as small as about 5 mm. A reduction in a sound pressure level attributable to interference between sounds output from the first speaker unit 3 and sounds output from the second speaker units 4 is unlikely to occur in the frequency range up to 20 KHz that is the audio reproduction band of the speaker system 1.

The difference between the distance from the listening point Q to the center P1 and the distance from the listening point Q to the centers P2 becomes smaller, the greater the distance from the center P1 of the first speaker unit 3 to the listening point Q. Therefore, interference of sounds is less likely to occur, the greater the distance from the center P1 of the first speaker unit 3 to the listening point Q.

Degradation of sound quality attributable to interference can be prevented by setting the distances L from the center P1 of the first speaker unit 3 to the centers P2 of the second speaker units 4 at 100 mm or less as described above. The effect of preventing degradation of sound quality attributable to interference can be improved by setting the distances L at 50 mm or less.

MODIFICATIONS

The first speaker unit 3 and the second speaker units 4 used as tweeters have been described above as an embodiment of the present disclosure in which a pair of speaker units having a great directivity angle is disposed above and below a speaker unit having a smaller directivity angle.

The disclosed technique is not limited to such an exemplary configuration involving three speakers, i.e., tweeters, and the disclosed technique may be applied to any of mid-range speakers, woofers, and full-range speakers.

The specific shapes and structures of the features according to the embodiment of the present disclosure are merely examples of implementation of the present disclosure, and such shapes and structures should not be taken as limiting the technical scope of the present disclosure.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker system comprising:

a woofer speaker;

one mid-range speaker; and a tweeter having (i) a first type tweeter speaker, and (ii) a pair of second type tweeter speakers which are disposed opposite to each other with the first type tweeter speaker sandwiched therebetween, the first type tweeter speaker is different from each of the second type tweeter speakers with regard to a number of speaker characteristics, such that the tweeter includes two different type of speakers, the one mid-range speaker is disposed below the first type tweeter speaker and the pair of second type tweeter speakers, and the tweeter is arranged such that audio signals in a first frequency band are input to the first type tweeter speaker and audio signals in a second frequency band are input to the pair of second type tweeter speakers, in which the first frequency band is the same as the second frequency band, and in which the second frequency band is shifted relative to the first frequency band toward a high frequency side thereof so that a sound pressure level of a composite audio signal obtained from audio signals of the first type tweeter speaker and the pair of second type tweeter speakers is continuous in a predetermined high frequency band whereat a non-continuous sound pressure level would otherwise occur in the absence of shifting the second frequency band relative to the first frequency band toward the high frequency side thereof.

2. A speaker system according to claim 1, in which the first type tweeter speaker and the pair of second type tweeter speakers are disposed so as to face toward a same direction, and in which distances from a center of the first type tweeter speaker to each center of the pair of second type tweeter speakers are equal to each other.

3. A speaker system according to claim 1, in which one speaker characteristic is a directivity angle in a horizontal direction such that each of the second type tweeter speakers has a directivity angle in the horizontal direction greater than that of the first type tweeter speaker.

4. A speaker system according to claim 1, in which one speaker characteristic is aperture such that the aperture of each of second type tweeter speakers is smaller than that of the first type tweeter speaker.

5. A speaker system according to claim 1, in which one speaker characteristic is sound pressure level such that a sum of sound pressure levels of the pair of second type tweeter speakers is 50% of a sound pressure level of the first type tweeter speaker or less when the first type tweeter speaker and the pair of second type tweeter speakers face a frontward direction of the system that is at an angle of 0°.

6. A speaker system according to claim 2, in which the distance from the center of the first speaker unit to the centers of the second speaker units is 100 mm or less.

7. A speaker system according to claim 1, further comprising a second woofer speaker such that the speaker system has two woofer speakers, and in which each of the two woofer speakers are disposed below the mid-range speaker.

* * * * *